US006840079B2

(12) United States Patent
Jorgenson et al.

(10) Patent No.: US 6,840,079 B2
(45) Date of Patent: Jan. 11, 2005

(54) AUTOMATED TUBE TEE FORMING AND TRIMMING SYSTEM

(75) Inventors: Edward O. Jorgenson, Auburn, WA (US); John M. Padmos, Port Orchard, WA (US)

(73) Assignee: The Boeing Company, Chicago, IL (US)

( * ) Notice: Subject to any disclaimer, the term of this patent is extended or adjusted under 35 U.S.C. 154(b) by 33 days.

(21) Appl. No.: 10/302,378

(22) Filed: Nov. 22, 2002

(65) Prior Publication Data

US 2004/0099035 A1 May 27, 2004

(51) Int. Cl.[7] ..... B21D 19/00; B21D 28/28

(52) U.S. Cl. ..... 72/335; 72/370.27; 29/890.148

(58) Field of Search ..... 72/335, 334, 340, 72/370.27, 370.01, 370.06; 29/890.148, 33 T

(56) References Cited

U.S. PATENT DOCUMENTS 1,813,152 A * 7/1931 Enghauser ..... 29/33 T
1,892,712 A * 1/1933 Hall ..... 72/348
3,064,707 A * 11/1962 Walts ..... 72/294
3,365,926 A * 1/1968 Price ..... 72/283
4,741,081 A * 5/1988 Redman ..... 29/890.148
5,237,849 A * 8/1993 Miyazawa ..... 72/335
5,909,908 A * 6/1999 Furuse ..... 29/33 T
6,044,683 A * 4/2000 Shigemoto ..... 72/335

* cited by examiner

*Primary Examiner*—Daniel C. Crane
(74) *Attorney, Agent, or Firm*—Shimokaji & Associates, P.C.

(57) ABSTRACT

An automatic tube tee forming and trimming system uses a single apparatus for milling a hole in a tube, pulling a forming die through the milled hole, and face trimming the resulting pullout joint to the desired height. The forming die is pulled out through the hole via a universal driver which is simply attached to the drawbar without requiring any twisting to lock the assembly. The system may automatically conduct each of the steps once the tube is loaded into the apparatus. The apparatus completes the tube tee forming and trimming process in a relatively small cell, without the need to travel out to another factory area, within a relatively short period of time, and with minimal use of manual labor.

18 Claims, 11 Drawing Sheets

AUTOMATED TUBE TEE FORMING AND TRIMMING SYSTEM

BACKGROUND OF THE INVENTION

The present invention generally relates to a tube tee forming and trimming system and, more specifically, to an automated, self-contained tube tee forming and trimming system for forming and trimming a pullout joint.

A pullout joint, also known as a tube tee, is formed in a tube to allow other tubes or fittings to be welded to the parent tube. Referring to FIG. 1, there is shown one example of a pullout joint 12 formed in a tube 10. Pullout joints must be accurately located, correctly formed, and trimmed to the required height.

A conventional pullout joint is made by attaching the part to a work surface and cutting an elliptical hole in the tube using either a laser or an abrasive water jet. The periphery of the cutout is then manually ground and polished to remove the heat affected material and cutting marks that will cause the material to crack when formed. After grinding, the part is cleaned to remove all anti spatter and grinding grit.

The area to be formed is coated with a forming lubricant. The detail is located in a form die in a forming press and clamped in place. A punch is heated to 500° F. using an induction-heating coil. After reaching the pre-set temperature, the punch is manually inserted into the tube and onto a drawbar that protrudes into the tube, through the elliptical cutout. The punch is rotated 90° and locked onto the drawbar. The press is then activated and the punch is drawn through the tube, forming the pullout. The part is removed from the tool and routed to the clean line to remove the forming lubricant.

After cleaning, the part is put in an assembly fixture and the pullout is scribed for the trim height, removed from the fixture and trimmed to the scribe line using a disk sander. After grinding the pullout to the scribe line, it is deburred and manually cleaned.

The above described conventional pullout forming and trimming process is quite lengthy, requiring large capital equipment and the use of several areas of the factory for the various steps.

As can be seen, there is a need for an improved tube tee forming and trimming system that solved both the technical and logistical issues related to forming and trimming a pullout joint. More specifically, there is a need for an automated, self-contained pullout joint forming and trimming system that completes the process in a relatively small cell, without the need to travel out to another factory area, within a relatively short period of time, and with minimal use of manual labor.

SUMMARY OF THE INVENTION

In one aspect of the present invention, a tee forming and trimming system comprises a milling head for milling a hole in a surface; a forming die forming a rough pullout joint when pulled from an inside region of the surface through said hole; a face trim head for trimming said rough pullout joint into a finished pullout joint; and a loading/moving system for automatically moving the surface from a position where the milling head makes the hole to a position where the forming die makes the pullout joint to a position where the face trim head trims the rough pullout joint into the finished pullout joint.

In another aspect of the present invention, a tube tee forming and trimming system comprises a milling head for milling a hole in a tube; a forming die forming a rough pullout joint when pulled from an inside region of the tube through the hole; a drawbar for pulling the forming die through the hole; a hydraulic cylinder for driving the drawbar; a face trim head, automatically interchangeable with the milling head, for trimming the rough pullout joint into a finished pullout joint; and a tube loading/moving system for automatically moving the tube from a position where the milling head makes the hole to a position where the forming die makes the pullout joint to a position where the face trim head trims the rough pullout joint into the finished pullout joint.

In yet another aspect of the present invention, a tube tee forming and trimming system for forming a pullout joint in aircraft ducting comprises a milling head for milling a hole in a titanium tube; a forming die forming a rough pullout joint when pulled from an inside region of the titanium tube through the hole; a drawbar for pulling the forming die through the hole; a hydraulic cylinder for driving the drawbar; a universal driver having a diameter smaller than a diameter of the forming die; the universal driver being located distal of the forming die relative to the drawbar; the drawbar attaching to the universal driver when the drawbar is extended into the hole and through the forming die, wherein the forming die is pulled up through the hole when the hydraulic cylinder drives the drawbar away from the titanium tube; a face trim head, automatically interchangeable with the milling head, for trimming the rough pullout joint into a finished pullout joint; and a tube loading/moving system for automatically moving the titanium tube from a position where the milling head makes the hole to a position where the forming die makes the pullout joint to a position where the face trim head trims the rough pullout joint into the finished pullout joint.

In a further aspect of the present invention, a tube tee forming and trimming system comprises a milling head for milling a hole in a tube; a forming die forming a rough pullout joint when pulled from an inside region of the tube through the hole; a drawbar for pulling the forming die through the hole; a hydraulic cylinder for driving the drawbar; a universal driver having a diameter smaller than a diameter of the forming die; the universal driver being located distal of the forming die relative to the drawbar; a presentation arm positioning the forming die and the universal driver in a position inside the tube such that when the drawbar is lowered into the tube, the drawbar is automatically aligned with the forming die and universal driver; a driver latch formed in the universal driver; the driver latch having a right half, a left half, and a top plate; a hole in the top plate such that when the left half is mated with the right half, the hole is smaller than the outside diameter of the drawbar; the left half and the right half of the driver latch resiliently contained in the universal driver such that when the drawbar extends into the universal driver, the left half and the right half elastically deform apart from each other; a groove in the drawbar being cut in a width at least as wide as the top plate, whereby when said groove reaches the top plate, the right half and the left half elastically return toward their original, mated positions, thereby locking the drawbar onto the universal driver; a face trim head, automatically interchangeable with the milling head, for trimming the rough pullout joint into a finished pullout joint; and a tube loading/moving system for automatically moving the tube from a position where the milling head makes the hole to a position where the forming die makes the pullout joint to a position where the face trim head trims the rough pullout joint into the finished pullout joint.

In still a further aspect of the present invention, a pullout forming die system comprises a drawbar for pulling a forming die through a material; a universal driver having a diameter smaller than a diameter of the forming die; the universal driver being located distal of the forming die relative to the drawbar; a driver latch formed in the universal driver; the driver latch having a right half, a left half, and a top plate; a hole in the top plate such that when the left half is mated with the right half, the hole is smaller than the outside diameter of the drawbar; the left half and the right half of the driver latch resiliently contained in the universal driver such that when the drawbar extends into the universal driver, the left half and the right half elastically deform apart from each other; and a groove in the drawbar being cut in a width at least as wide as the top plate, whereby when the groove reaches the top plate, the right half and the left half elastically return toward their original, mated positions, thereby locking the drawbar onto the universal driver.

In still a further aspect of the present invention, a method for forming and trimming a tube tee comprises milling a hole in a tube; pulling a forming die through the hole to form a rough pullout joint; trimming the rough pullout joint with a face trim head to form a finished pullout joint; and automatically moving the tube from a position where the milling head makes the hole to a position where the forming die makes the pullout joint to a position where the face trim head trims the rough pullout joint into the finished pullout joint.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides an automated tube tee forming and trimming system useful for forming and trimming pullout joints in a tube. The ability to provide accurate and simple formation of pullout joints in a tube may be useful in a wide variety of industries using the movement of air and fluid through tubes. For example, the aircraft industry uses ducting for the movement of air, for fuel vent tubes and for fuel feed lines. The food processing industry and wineries also use tubes of various sizes and designs.

Conventional pullout joint forming and trimming methods require a significant amount of factory space to perform the various steps in the forming and trimming process. The automated tube tee forming and trimming system of the present invention addresses this issue by forming and trimming a pullout joint in a single, self-contained apparatus.

Conventional pullout joint forming and trimming methods require a significant amount of user intervention to make the final product. The automated tube tee forming and trimming system of the present invention addresses this issue by forming and trimming a pullout joint in an automated fashion, requiring very little operator time and intervention.

Conventional pullout joint forming and trimming methods require the drawbar to twist to lock into the form die prior to pulling the form die through the hole in the tube. The automated tube tee forming and trimming system of the present invention provides a simple locking mechanism to lock the drawbar into the form die without requiring any rotational motion.

Figure 1:
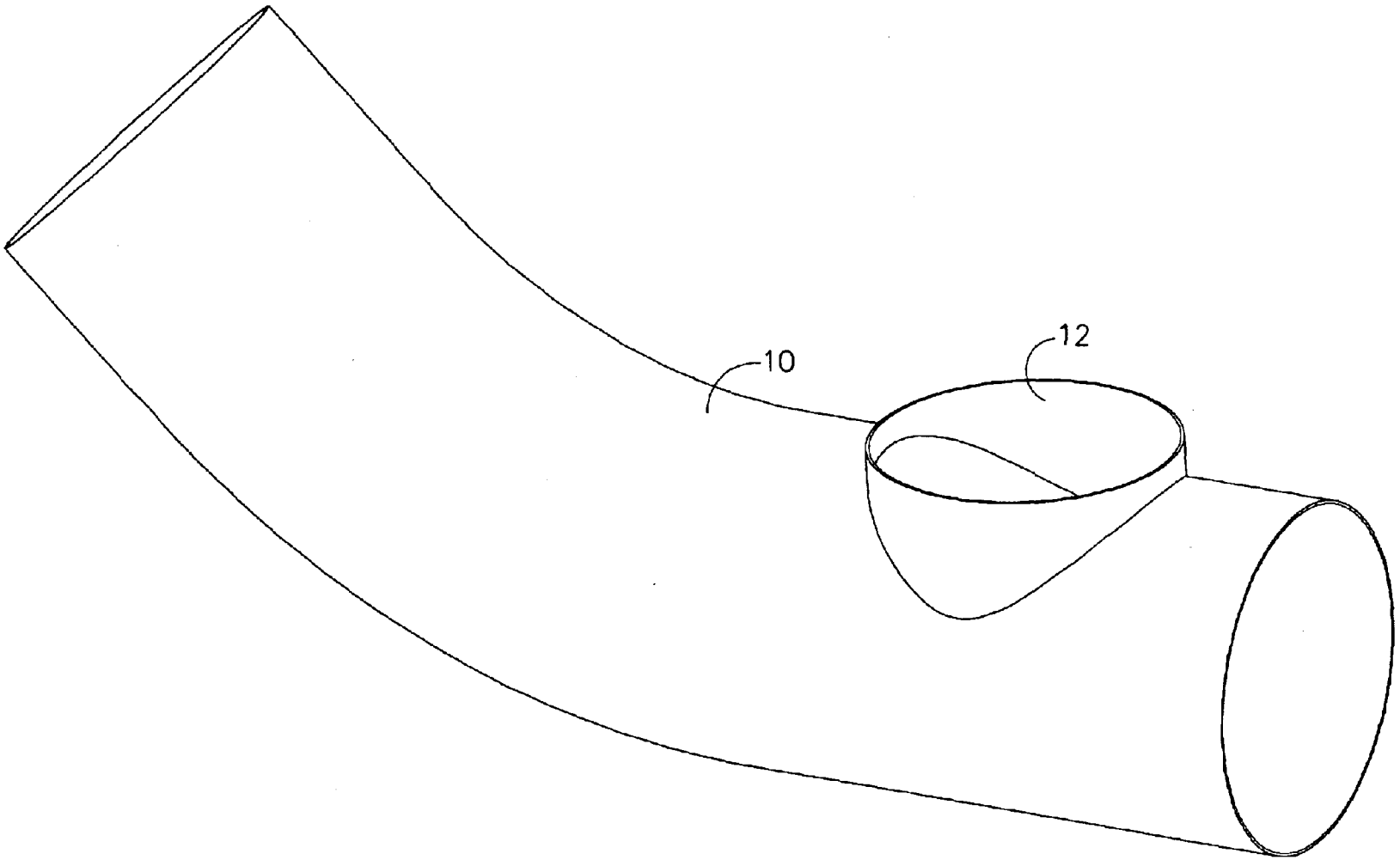
FIG. 1 is a perspective view showing a pullout joint formed in a tube.
Figure 2:
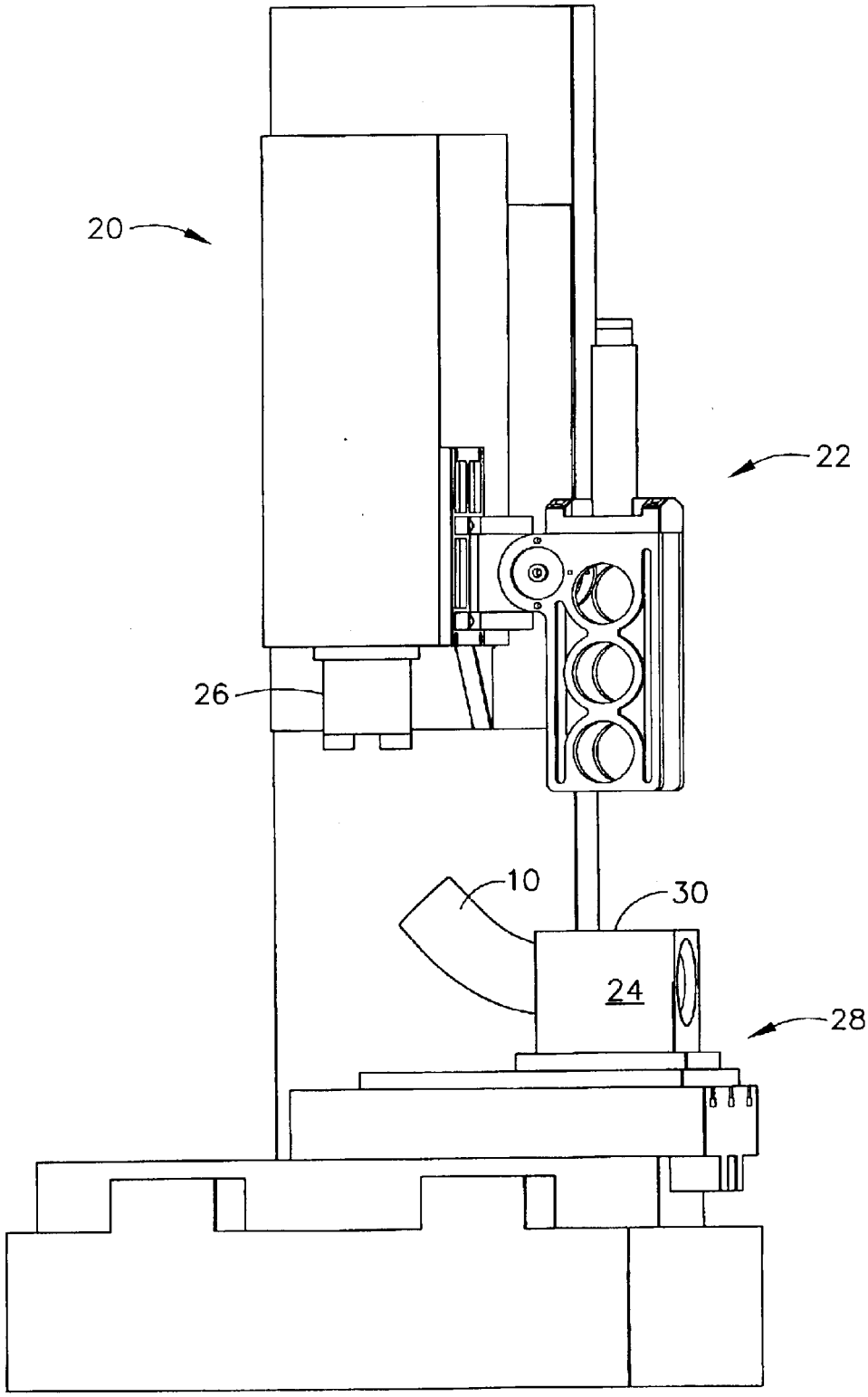
FIG. 2 is a perspective drawing of the tube trimming and forming apparatus according to one embodiment of the present invention in a part load position.

Referring to FIG. 2, there is shown a perspective drawing of the tube trimming and forming apparatus of the present invention in a part load position. A pullout forming portion 22 may be attached to a milling portion 20. Milling portion 20 may be any conventional machining tool. For example, milling portion 20 may be a Fryer Machine Systems MC-20 computer numerical control (CNC) vertical 3-axis mill machining center. The CNC machine controller (not shown) may be used to drive the 3-axis mill, as well as activate pullout forming portion 22 and control a tube loading/moving system 28.

A tube 10 may be placed in a tube holder 24 of tube loading/moving system 28. A top portion 30 of tube holder 24 may have an opening to allow a milling head 26 to pass therethrough.

Figure 3:
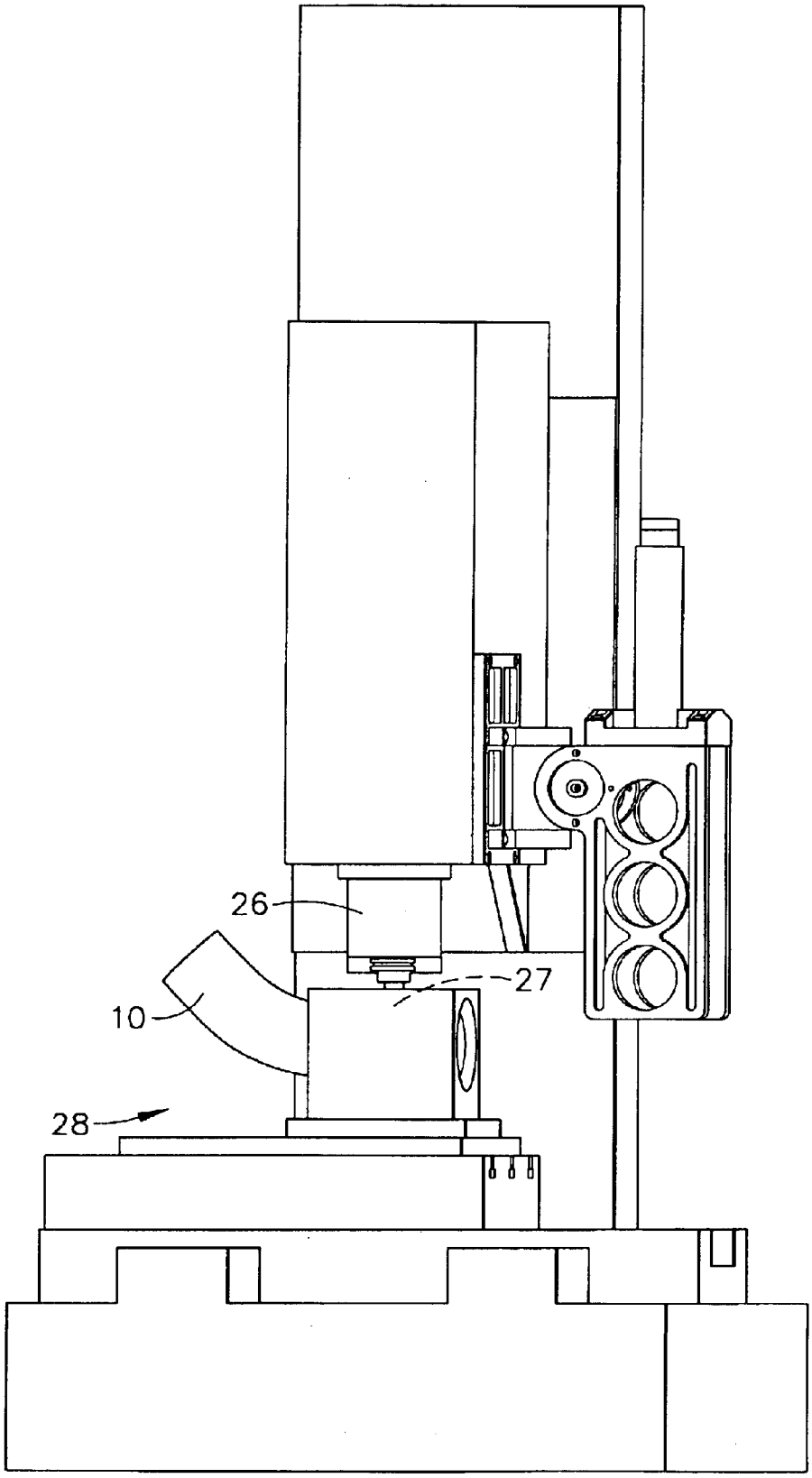
FIG. 3 is a perspective drawing of the tube trimming and forming apparatus according to one embodiment of the present invention in a milling position.

Referring now to FIG. 3, there is shown a perspective drawing of the tube trimming and forming apparatus of the present invention in a milling position. Tube loading/moving system. 28 may move the loaded tube 10 from the loading position to a milling position. Milling head 26 may move toward tube 10, cutting a predetermined-sized elliptical hole 27 into tube 10.

Figure 4:
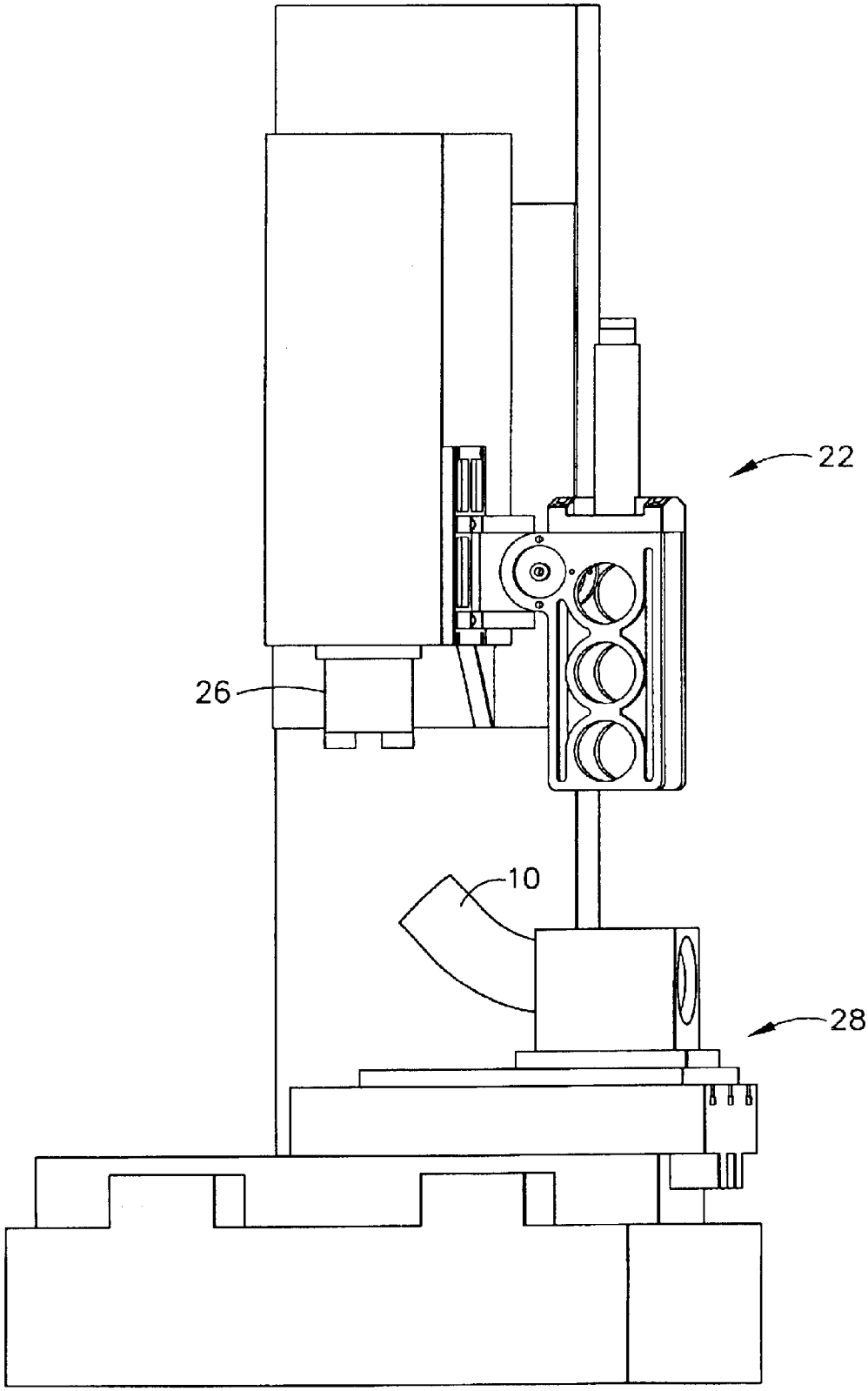
FIG. 4 is a perspective drawing of the tube trimming and forming apparatus according to one embodiment of the present invention moving from the milling position to a pullout position.

Referring to FIG. 4, there is shown a perspective drawing of the tube trimming and forming apparatus of the present invention moving from the milling position to a pullout position. Milling head 26 may move from a cutting position to it original, non-cutting position. Tube loading/moving system 28 may slide tube 10, now having an elliptical hole cut therethrough, from the milling position to the pullout position. Elliptical hole 27 may then be aligned with pullout forming portion 22.

Figure 5:
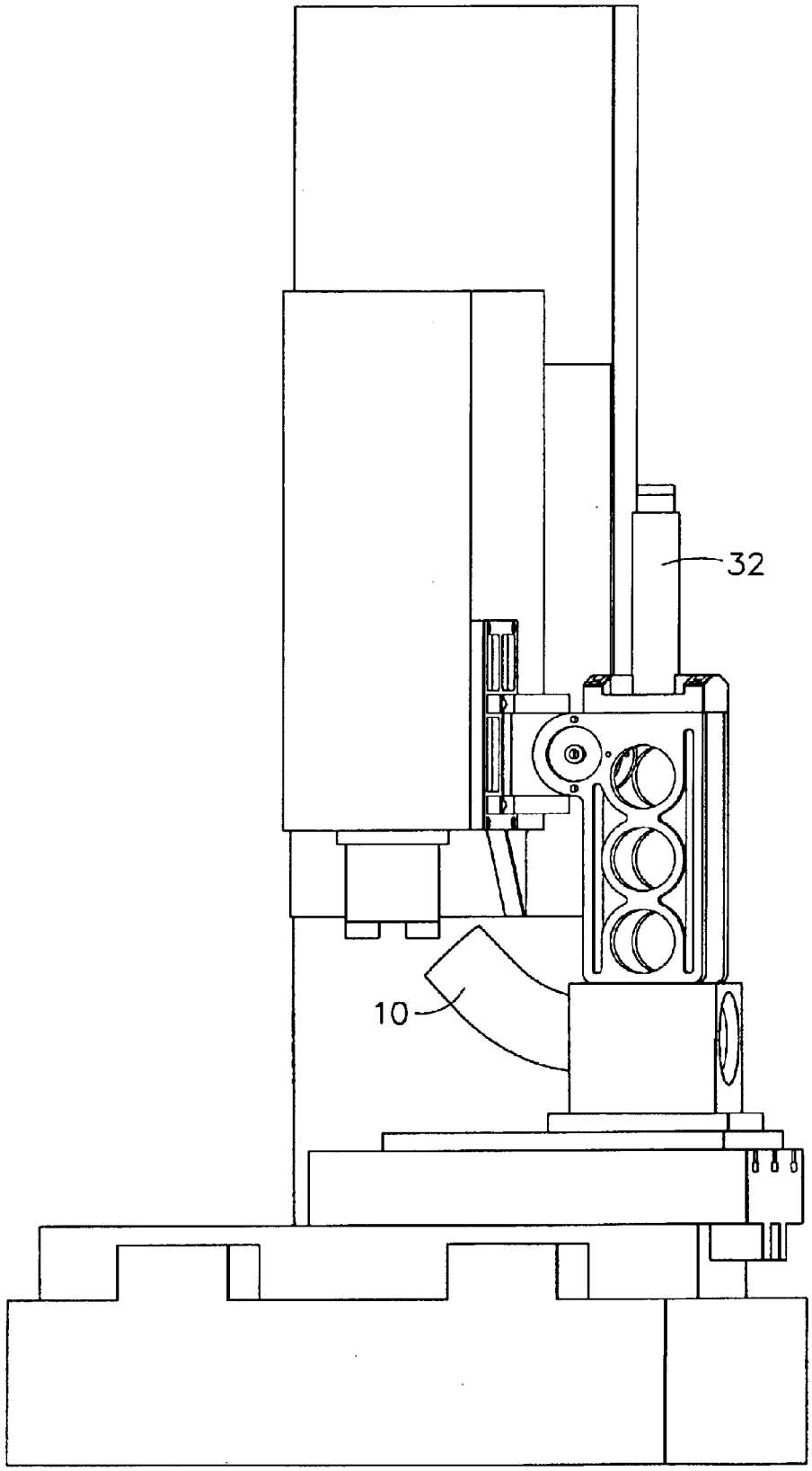
FIG. 5 is a perspective drawing of the tube trimming and forming apparatus according to one embodiment of the present invention in a pullout forming position.
Figure 6:
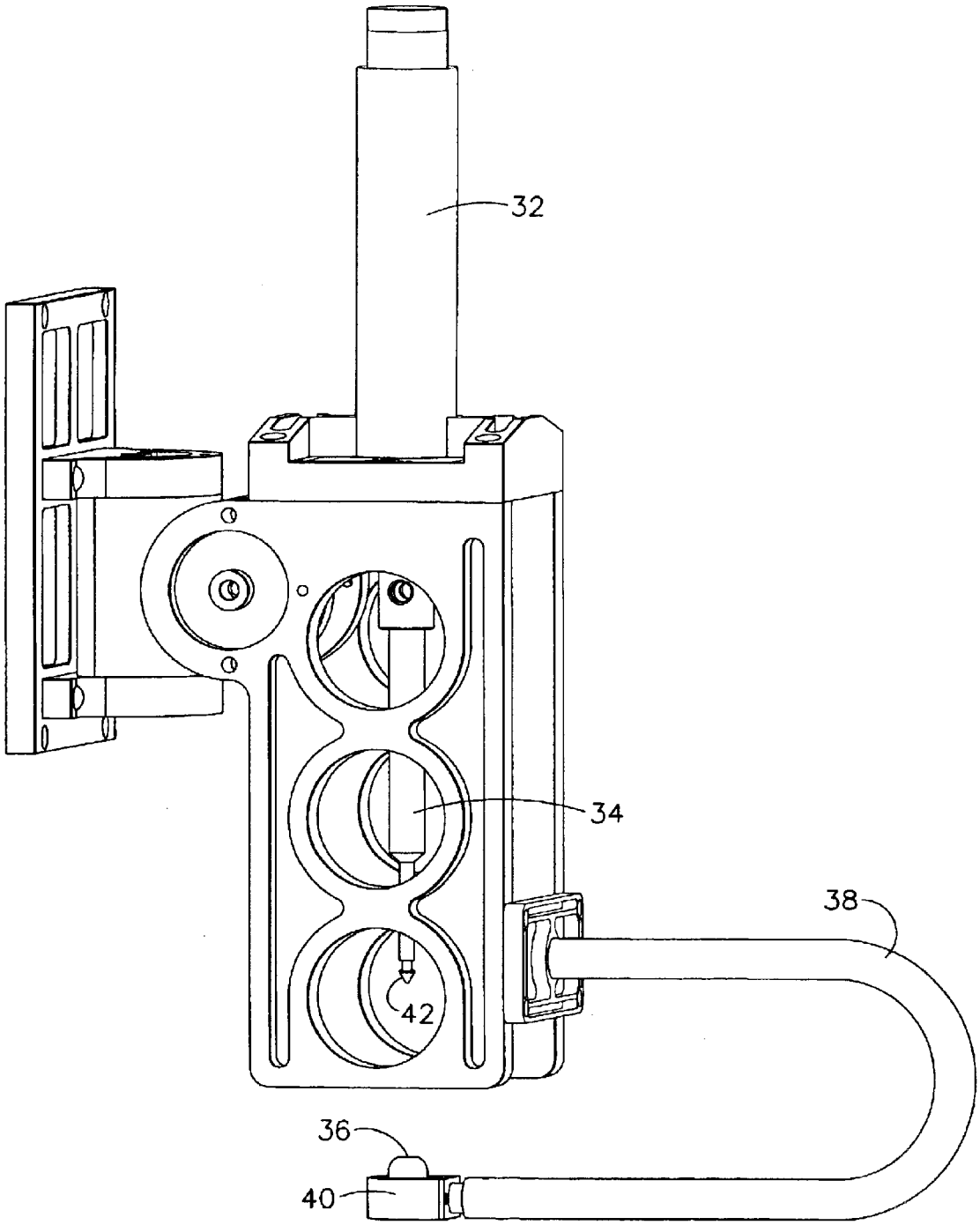
FIG. 6 is a perspective drawing of the pullout forming portion of the tube trimming and forming apparatus according to one embodiment of the present invention.
Figure 7:
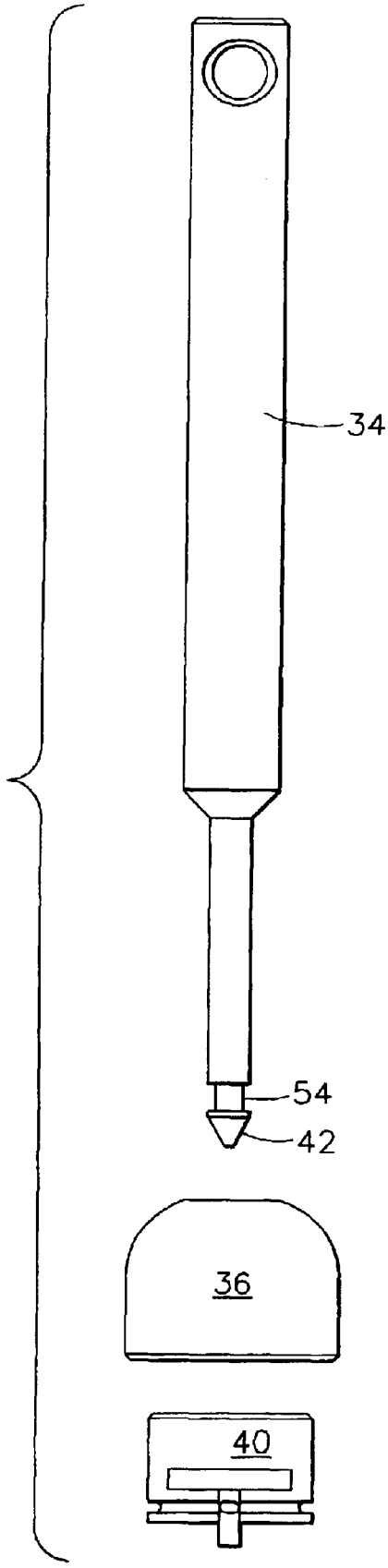
FIG. 7 is a schematic drawing showing the forming die system according to one embodiment of the present invention.

Referring on to FIGS. 5, 6 and 7, there are shown perspective drawings of the tube trimming and forming apparatus of the present invention. A hydraulic cylinder 32 may drive a drawbar 34 through elliptical hole 27 of tube 10 and through a hole in a forming die 36. Forming die 36 may have an outside diameter sized at the desired inside diameter of the pullout joint.

A universal driver 40 may be positioned distal to forming die 36, relative to drawbar 34, to engage an engagement end 42 of drawbar 34. Once drawbar 34 engages universal driver 40, hydraulic cylinder 32 may move to lift forming die 36, along with universal driver 40, through the elliptical hole in tube 10, forming a rough pullout joint—such as pullout joint 12—therein. Universal driver 40 may have a diameter smaller than that of forming die 36, thereby allowing universal driver 40 to pass through the rough pullout joint—such as pullout joint 12—along with forming die 36. Universal driver 40 may be used with any sized forming die 36, so long as the diameter of universal driver 40 is smaller than that of forming die 36.

A forming die presentation arm 38 may be used to align forming die 36 with drawbar 34. If a pullout joint is to be formed at a central portion of a very long tube, forming die presentation arm 38 may be eliminated and forming die 36 manually located in tube 10 beneath the elliptical hole.

Figure 8:
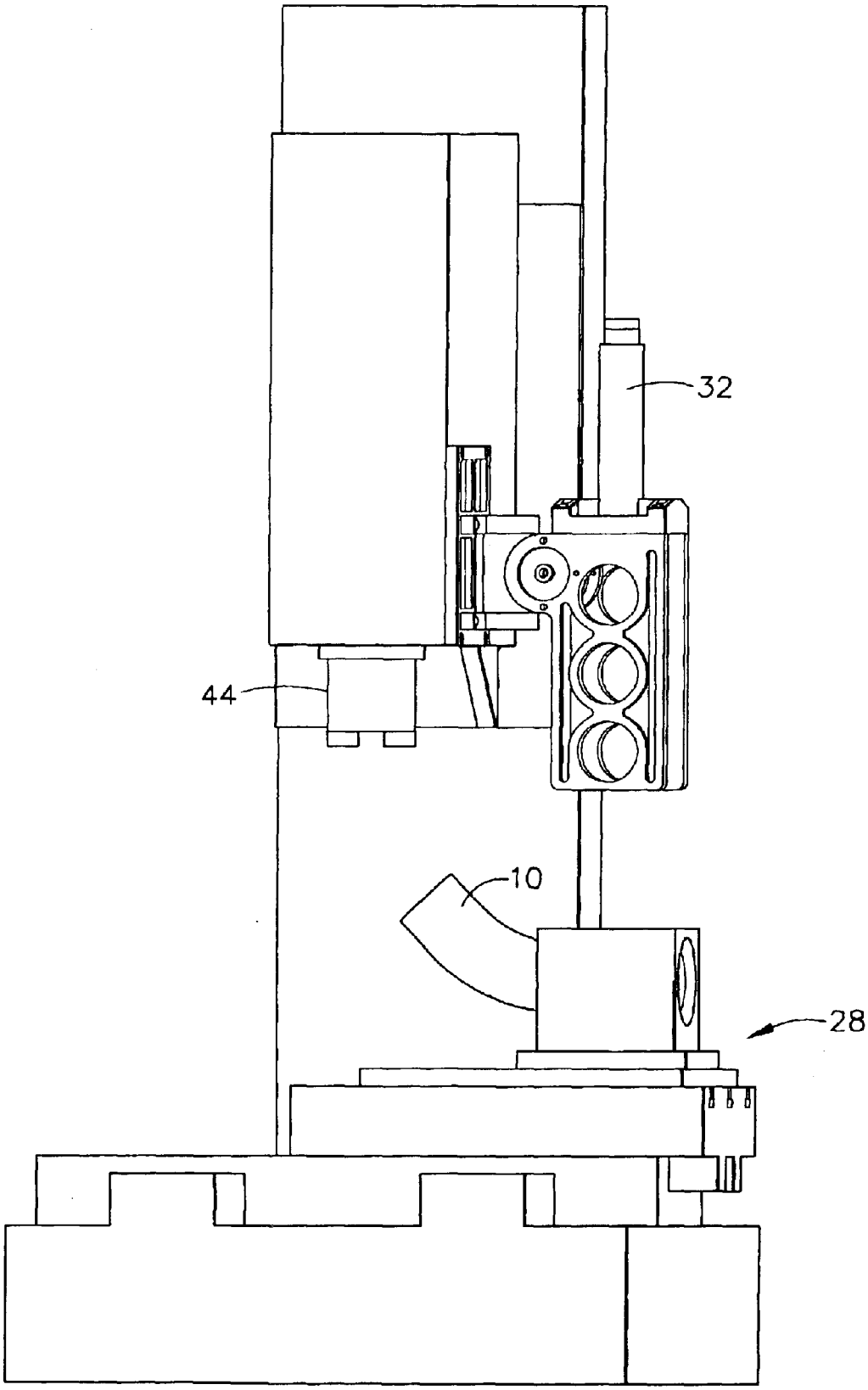
FIG. 8 is a perspective drawing of the tube trimming and forming apparatus according to one embodiment of the present invention once the rough pullout joint is formed.

Referring now to FIG. 8, there is shown a perspective drawing of the tube trimming and forming apparatus of the present invention once the rough pullout joint is formed. After hydraulic cylinder 32 pulls out of tube 10, the rough pullout joint is formed. At this point, milling head 26 (not shown) may be changed to a face trim head 44. Tube loading/moving system 28 may slide tube 10 from a pullout forming position back to the original milling position.

Figure 9:
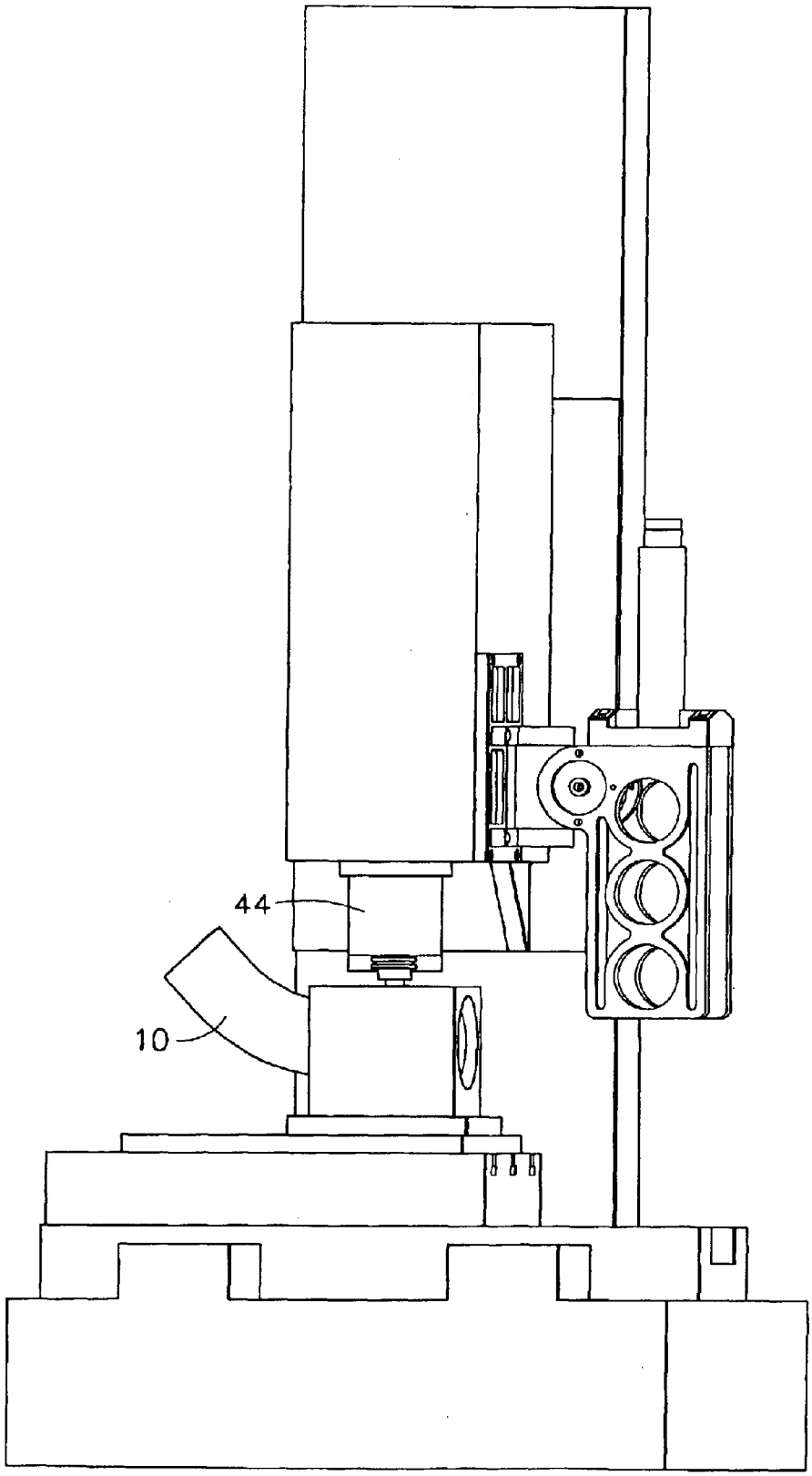
FIG. 9 is a perspective drawing of the tube trimming and forming apparatus according to one embodiment of the present invention in a face trimming position.

Referring to FIG. 9, there is shown a perspective drawing of the tube trimming and forming apparatus of the present invention in a face trim position. Face trim head 26 may lower to trim excess material from the rough pullout joint and to make the rough pullout joint of the correct drawing height.

Figure 10:
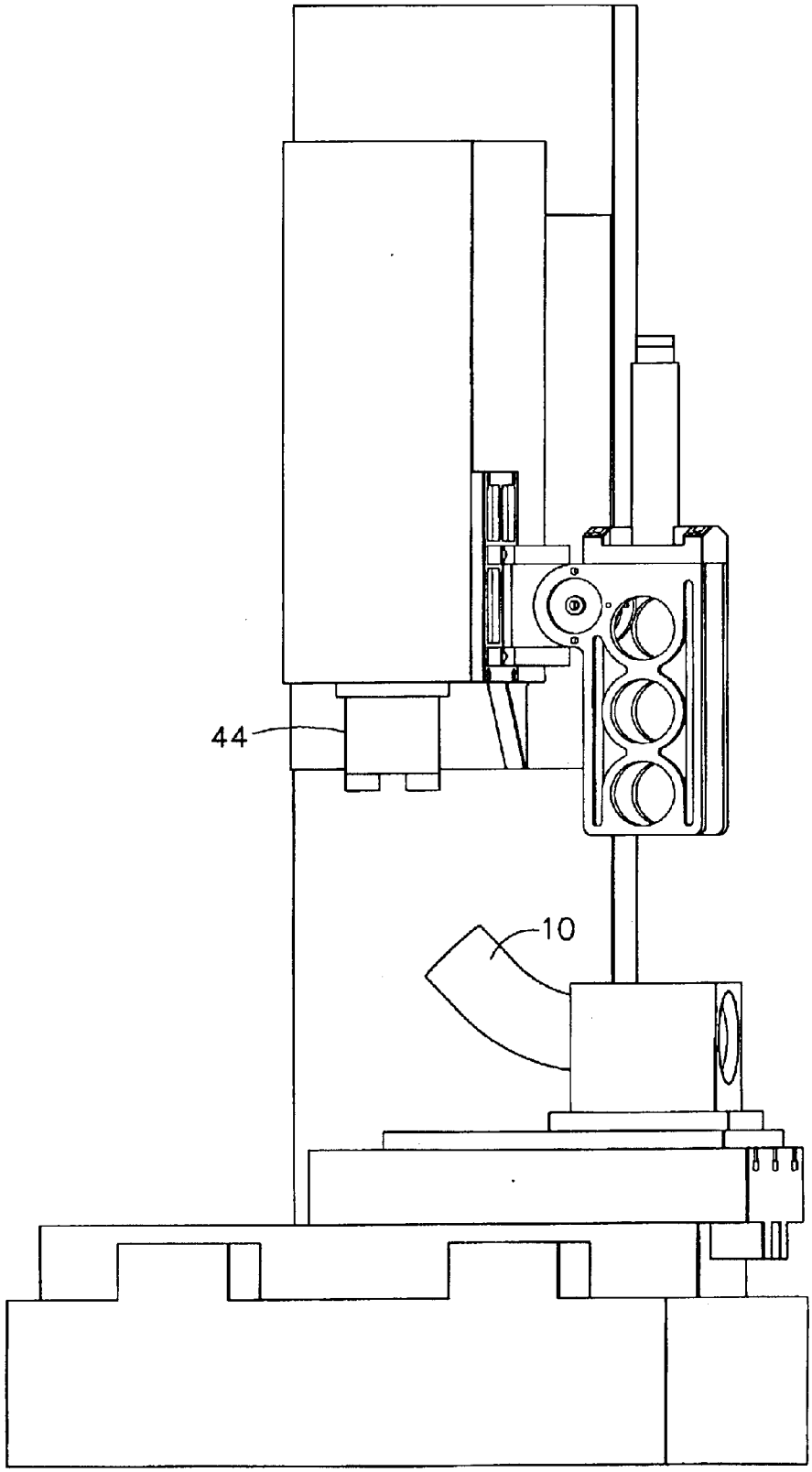
FIG. 10 is a perspective drawing of the tube trimming and forming apparatus according to one embodiment of the present invention in a part unload position.

Referring to FIG. 10, there is shown a perspective drawing of the tube trimming and forming apparatus of the present invention in an unload position. After face trim head 44 completes the trimming of the pullout joint, face trim head 44 may rise and tube loading/moving system 28 may move tube 10 to an unloading position. Tube 10 may be removed to give completed part having pullout joint 12.

Referring now to FIGS. 7, 11, 12 and 13, there is shown more detailed views of the universal driver 40/forming die 36 assembly used to receive engagement end 42 of drawbar 34. A driver latch 48 may be made from a left half 48L and a right half 48R. Left half 48L and right half 48R come together to form a top plate 56 of driver latch 48 having a hole 52 in the center thereof. Hole 52 may be made at approximately the same diameter of drawbar 34. From each of left half 48L and right half 48R may extend a left leg 50L and a right leg 50R.

A groove 54 at engagement end 42 of drawbar 34 may be made to give drawbar a reduced diameter approximately the same as the diameter of hole 52 when right half 48R and left half 48L are mated. Groove 54 may have a width approximately the same as the width of top plate 56 of driver latch 48.

Figure 11:
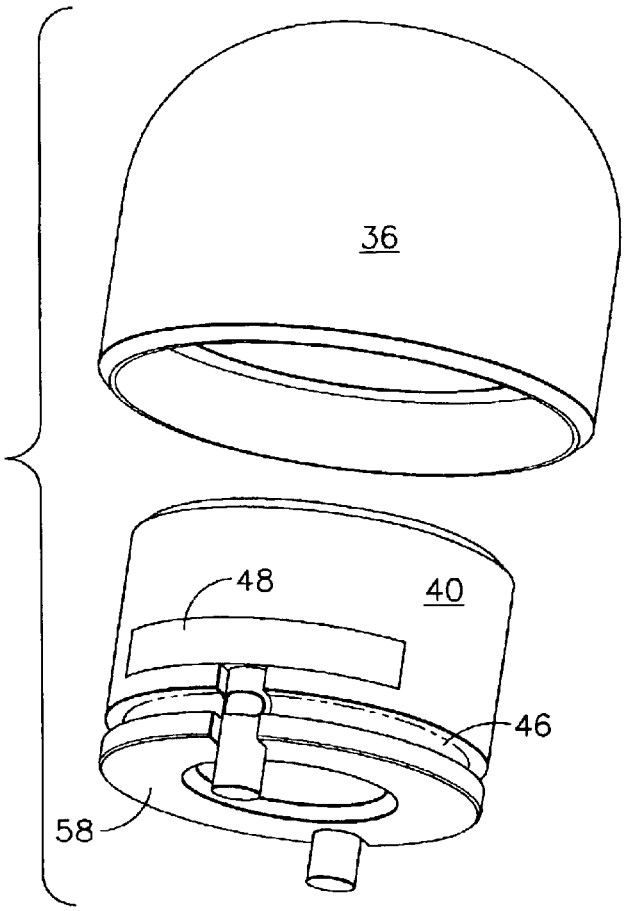
FIG. 11 is a schematic drawing showing the pullout forming die system according to one embodiment of the present invention.
Figure 13:
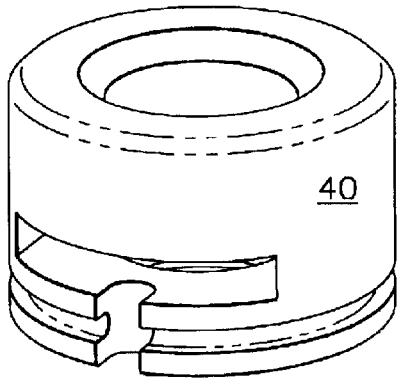
FIG. 13 is a perspective drawing showing the universal driver used in one embodiment of the present invention.
Figure 12:
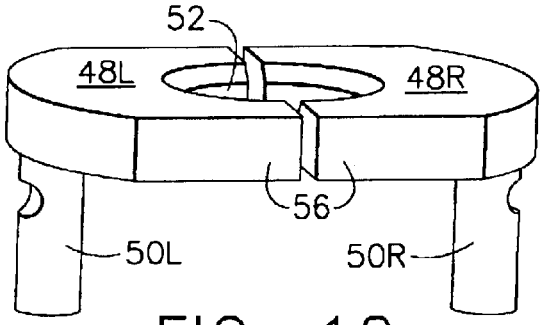
FIG. 12 is a close-up drawing showing the driver latch part used in one embodiment of the present invention.

Driver latch 48 may be installed in universal driver 40 as shown in FIG. 11. A channel 46 may be made around the circumference of universal driver 40 as well as in a portion of left leg 50L and right leg 50R to form a continuous channel about universal driver 40. An elastically resilient band (not shown) may be placed in channel 46 to maintain a pressure on left leg 50L and right leg 50R, thereby keeping left half 48L and right half 48R pressed together. The elastically resilient band may be made of any material that provides sufficient resiliency against left leg 50L and right leg 50R. Such materials may include metal bands or clips as well as rubber bands or o-rings.

When drawbar 34 is inserted through forming die 36, through universal driver 40 and into hole 52 of driver latch 48, the outside diameter of drawbar 34 presses left half 48L and right half 48R resiliently apart. Once groove 54 of drawbar 34 is aligned with top plate 56, left half 48L and right half 48R resiliently snap back into groove 54, thereby locking universal driver 40 onto drawbar 34. Thus, when drawbar 34 is raised, universal driver 40 is raised against forming die 36, raising forming die 36 through the hole in the tube, thereby creating the rough pullout joint.

Right arm 5OR and left arm 50L may extend beyond a bottom face 58 of universal driver 40. This allows for a user, or another device to resiliently move right arm 50R and left arm 50L to separate right half 48R and left half 48L out of groove 54. This allows for the simple remove of forming die 36 and universal driver 40 from drawbar 34.

The present invention may be used to make pullout joints of any size in practically any diameter tube. The present invention is especially useful in making pullout joints from about 1 to about 5 inches in a tubular material.

The tubular material may be any material through which a pullout joint may be formed. Such materials include, but are not limited to titanium, stainless steel, thin-walled inconel, copper, brass, and alloys, such as high nickel alloys.

The present invention has been described using a tubular material for making the pullout joint therein. However, the invention is not meant to be limited to materials of any particular size or shape. For example, a rectangular duct may be used as a starting material to have a pullout joint formed therethrough.

The present invention has been described using an elliptical hole being first milled in the tubular material. As one having ordinary skill in the art could envision, a hole of such shape is made to minimize the excess material that must be trimmed when face trimming the rough pullout joint to the desired drawing height. The present invention, however, is not meant to be limited to initial holes of any particular shape. For example, round holes may be milled in the tubular material and the excess trimmed in the trimming step.

It should be understood, of course, that the foregoing relates to preferred embodiments of the invention and that modifications may be made without departing from the spirit and scope of the invention as set forth in the following claims.

We claim:

1. A tee forming and trimming system comprising:

a milling head milling a hole in a surface;

a forming die forming a rough pullout joint when pulled from an inside region of said surface through said hole;

a drawbar for pulling said forming die through said hole;

a hydraulic cylinder for driving said drawbar;

a universal driver;

said universal driver being located distal of said forming die relative to said drawbar;

said drawbar attaching to said universal driver when said drawbar is extended into said hole and through said forming die, wherein said forming die is pulled up through said hole when said hydraulic cylinder drives said drawbar away from said tube;

a face trim head trimming said rough pullout joint into a finished pullout joint; wherein said face trim head is automatically exchanged with said milling head, thereby completing a milling operation and a face trimming operation at the same location of said tube tee forming and trimming system; and a loading/moving system automatically moving said surface from a position where said milling head makes said hole to a position where said forming die makes said pullout joint to a position where said face trim head trims said rough pullout joint into said finished pullout joint.

2. The tee forming and trimming system according to claim 1, wherein said universal driver has a diameter smaller than said forming die, thereby allowing said universal driver to be at least partially positioned within an interior region of said forming die.

3. The tee forming and trimming system according to claim 1, wherein said forming die is interchangeable among a variety of sizes, each of said variety of sizes being driven by said drawbar being connected to the same universal driver.

4. The tee forming and trimming system according to claim 1, further comprising a presentation arm positioning said forming die and said universal driver in a position inside said tube such that when said drawbar is lowered into said tube, said drawbar is automatically aligned with said forming die and universal driver.

5. The tee forming and trimming system according to claim 4, further comprising:

a driver latch formed in said universal driver;

said driver latch having a right half, a left half, and a top plate;

a hole in said top plate such that when said left half is mated with said right half, said hole is smaller than the outside diameter of said drawbar;

said left half and said right half of said driver latch resiliently contained in said universal driver such that when said drawbar extends into said universal driver, said left half and said right half elastically deform apart from each other; and a groove in said drawbar being cut in a width at least as wide as said top plate, whereby when said groove reaches said top plate, said right half and said left half elastically return toward their original, mated positions, thereby locking said drawbar onto said universal driver.

6. The tee forming and trimming system according to claim 5, further comprising a left arm and a right arm being pendant from said left half and said right half of said driver latch, said left arm and said right arm providing points to elastically deform said right half and said left half, thereby detaching said drawbar from said universal driver at an appropriate time.

7. The tee forming and trimming system according to claim 1, wherein said surface is a surface of a tube.

8. A tube tee forming and trimming system comprising:

a milling head milling a hole in a tube;

a forming die forming a rough pullout joint when pulled from an inside region of said tube through said hole;

a drawbar pulling said forming die through said hole;

a hydraulic cylinder driving said drawbar;

a face trim head, automatically interchangeable with said milling head, trimming said rough pullout joint into a finished pullout joint; and a tube loading/moving system automatically moving said tube from a position where said milling head makes said hole to a position where said forming die makes said pullout joint to a position where said face trim head trims said rough pullout joint into said finished pullout joint.

9. The tube tee forming and trimming system according to claim 8, further comprising:

a universal driver having a diameter smaller than a diameter of said forming die;

said universal driver being located distal of said forming die relative to said drawbar;

said drawbar attaching to said universal driver when said drawbar is extended into said hole and through said forming die, wherein said forming die is pulled up through said hole when said hydraulic cylinder drives said drawbar away from said tube; and said forming die is interchangeable among a variety of sizes, each of said variety of sizes being driven by said drawbar being connected to the same universal driver.

10. The tube tee forming and trimming system according to claim 9, further comprising:

a presentation arm positioning said forming die and said universal driver in a position Inside said tube such that when said drawbar is lowered into said tube, said drawbar is automatically aligned with said forming die and universal driver;

a driver latch formed in said universal driver;

said driver latch having a right half, a left half, and a top plate;

a hole In said top plate such that when said left half is mated with said right half, said hole is smaller than the outside diameter of said drawbar;

said left half and said right half of said driver latch resiliently contained in said universal driver such that when said drawbar extends into said universal driver, said left half and said right half elastically deform apart from each other; and a groove in said drawbar being cut in a width at least as wide as said top plate, whereby when said groove reaches said top plate, said right half and said left half elastically return toward their original, mated positions, thereby locking said drawbar onto said universal driver.

11. A tube tee forming and trimming system for forming a pullout joint in aircraft ducting comprising:

a milling head milling a hole in a titanium tube;

a forming die forming a rough pullout joint when pulled from an inside region of said titanium tube through said hole;

a drawbar pulling said forming die through said hole;

a hydraulic cylinder driving said drawbar;

a universal driver having a diameter smaller than a diameter of said forming die;

said universal driver being located distal of said forming die relative to said drawbar;

said drawbar attaching to said universal driver when said drawbar is extended into said hole and through said forming die, wherein said forming die is pulled up through said hole when said hydraulic cylinder drives said drawbar away from said titanium tube;

a face trim head, automatically interchangeable with said milling head, trimming said rough pullout joint into a finished pullout joint; and a tube loading/moving system automatically moving said titanium tube from a position where said milling head makes said hole to a position where said forming die makes said pullout joint to a position where said face trim head trims said rough pullout joint into said finished pullout joint.

12. The tube tee forming and trimming system according to claim 11, further comprising a presentation arm positioning said forming die and said universal driver in a position inside said titanium tube such that lowering said drawbar into said titanium tube engages said drawbar with said universal driver.

13. The tube tee forming and trimming system according to claim 12, further comprising:

a driver latch formed in said universal driver;

said driver latch having a right half, a left half, and a top plate;

a hole in said top plate such that when said left half is mated with said right half, said hole is smaller than the outside diameter of said drawbar;

said left half and said right half of said driver latch resiliently contained in said universal driver such that when said drawbar extends into said universal driver, said left half and said right half elastically deform apart from each other;

a groove in said drawbar being cut in a width at least as wide as said top plate; and said right half and said left half elastically returning toward their original, mated positions when said groove reaches said top plate, thereby locking said drawbar onto said universal driver.

14. A tube tee forming and trimming system comprising:

a milling head milling a hole in a tube;

a forming die forming a rough pullout joint when pulled from an inside region of said tube through said hole;

a drawbar pulling said forming die through said hole;

a hydraulic cylinder driving said drawbar;

a universal driver having a diameter smaller than a diameter of said forming die;

said universal driver being located distal of said forming die relative to said drawbar;

a presentation arm positioning said forming die and said universal driver in a position inside said tube such that when said drawbar is lowered into said tube, said drawbar is automatically aligned with said forming die and universal driver;

a driver latch formed in said universal driver;

said driver latch having a right half, a left half, and a top plate;

a hole in said top plate such that when said left half is mated with said right half, said hole is smaller than the outside diameter of said drawbar;

said left half and said right half of said driver latch resiliently contained in said universal driver such that when said drawbar extends into said universal driver, said left half and said right half elastically deform apart from each other;

a groove in said drawbar being cut in a width at least as wide as said top plate;

said right half and said left half elastically returning toward their original, mated positions when said groove reaches said top plate, thereby locking said drawbar onto said universal driver;

a face trim head, automatically interchangeable with said milling head, for trimming said rough pullout joint into a finished pullout joint; and a tube loading/moving system for automatically moving said tube from a position where said milling head makes said hole to a position where said forming die makes said pullout joint to a position where said face trim head trims said rough pullout joint into said finished pullout joint.

15. A pullout forming die system comprising:

a drawbar pulling a forming die through a material;

a universal driver having a diameter smaller than a diameter of said forming die;

said universal driver being located distal of said forming die relative to said drawbar;

a driver latch formed in said universal driver;

said driver latch having a right half, a left half, and a top plate;

a hole in said top plate such that when said left half is mated with said right half, said hole is smaller than the outside diameter of said drawbar;

said left half and said right half of said driver latch resiliently contained in said universal driver such that when said drawbar extends into said universal driver, said left half and said right half elastically deform apart from each other;

a groove in said drawbar being cut in a width at least as wide as said top plate; and said right half and said left half elastically return toward their original, mated positions when said groove reaches said top plate, thereby locking said drawbar onto said universal driver.

16. The pullout forming die system according to claim 15, further comprising:

a left arm and a right arm being pendant from said left half and said right half of said driver latch; and said left arm and said right arm extending below a bottom face of said universal driver, thereby providing points to elastically deform said right half and said left half, whereby said drawbar may be purposefully detached from said universal driver.

17. A method for forming and trimming a tube tee comprising:

milling a hole in a tube using a milling head;

driving a drawbar with a hydraulic cylinder;

pulling a forming die through said hole using said drawbar to form a rough pullout joint;

providing a universal driver at a position distal of said forming die relative to said drawbar;

attaching said drawbar to said universal driver when said drawbar is extended into said hole and through said forming die;

pulling said universal driver up through said hole when said hydraulic cylinder drives said drawbar away from said tube, thereby forming said rough pullout joint;

automatically exchanging a face trim head with said milling head;

trimming said rough pullout joint with said face trim head to form a finished pullout joint; and automatically moving said tube from a position where said milling head makes said hole to a position where said forming die makes said pullout joint to a position where said face trim head trims said rough pullout joint into said finished pullout joint.

18. The method according to claim 17, further comprising positioning said forming die and said universal driver inside said tube with a positioning arm such that when said drawbar is lowered into said tube, said drawbar is automatically aligned with said forming die and universal driver.

* * * * *